US008662027B2

(12) United States Patent
Knollmayr et al.

(10) Patent No.: US 8,662,027 B2
(45) Date of Patent: Mar. 4, 2014

(54) METHOD FOR MACHINING A CYLINDER HEAD COMPRISING A COOLING JACKET

(75) Inventors: Christof Knollmayr, Graz (AT); Robert Berger, Strallegg (AT)

(73) Assignee: AVL List GmbH, Graz (AT)

( * ) Notice: Subject to any disclaimer, the term of this patent is extended or adjusted under 35 U.S.C. 154(b) by 343 days.

(21) Appl. No.: 12/452,376

(22) PCT Filed: Jun. 23, 2008

(86) PCT No.: PCT/EP2008/057941

§ 371 (c)(1),
(2), (4) Date: Jan. 22, 2010

(87) PCT Pub. No.: WO2009/000799

PCT Pub. Date: Dec. 31, 2008

(65) Prior Publication Data

US 2010/0132638 A1 Jun. 3, 2010

(30) Foreign Application Priority Data

Jun. 28, 2007 (AT) ..... A 1007/2007
Jul. 17, 2007 (AT) ..... A 1129/2007

(51) Int. Cl.
*F02F 1/40* (2006.01)

(52) U.S. Cl.
USPC ..... 123/41.72; 29/888.06

(58) Field of Classification Search
USPC ..... 123/41.72, 193.2; 29/888.06
See application file for complete search history.

(56) References Cited

U.S. PATENT DOCUMENTS

| | | | | | |
|---|---|---|---|---|---|
| 1,979,066 | A | * | 10/1934 | Fink | 123/312 |
| 1,996,798 | A | * | 4/1935 | Ehrling | 123/41.74 |
| 2,402,889 | A | * | 6/1946 | Herreshoff | 123/41.77 |
| 2,456,951 | A | * | 12/1948 | Klotsch | 123/41.74 |
| 2,867,201 | A | * | 1/1959 | Dolza et al. | 123/195 R |
| 2,996,050 | A | * | 8/1961 | Caris | 123/41.72 |
| 3,186,384 | A | * | 6/1965 | Fuhrmann | 277/357 |
| 3,186,387 | A | * | 6/1965 | Kolbe et al. | 123/41.74 |
| 3,315,651 | A | * | 4/1967 | Dangauthier | 123/41.28 |
| 4,559,684 | A | | 12/1985 | Pryor | |
| 4,805,563 | A | * | 2/1989 | Nishimura et al. | 123/41.82 A |
| 5,460,140 | A | * | 10/1995 | Porter | 123/195 R |
| 5,542,381 | A | * | 8/1996 | Noda et al. | 123/41.74 |
| 6,981,473 | B2 | * | 1/2006 | Gunji et al. | 123/41.82 R |
| 7,069,918 | B2 | * | 7/2006 | Mackey et al. | 123/568.12 |

FOREIGN PATENT DOCUMENTS

| | | |
|---|---|---|
| DE | 19840379 | 3/2000 |
| JP | 2000338090 | 12/2000 |
| WO | 2004005914 | 1/2004 |

OTHER PUBLICATIONS

English Abstract of DE 19840379.
English Abstract of JP 2000338090.

* cited by examiner

*Primary Examiner* — Noah Kamen
*Assistant Examiner* — Long T Tran
(74) *Attorney, Agent, or Firm* — Dykema Gossett PLLC

(57) ABSTRACT

A method for machining a cylinder head including a cooling jacket, wherein the fire deck of the cylinder head which is in a raw state is machined by material removal in relation to a reference mark of the cylinder head. The position of the cooling jacket is used as a reference mark.

6 Claims, 5 Drawing Sheets

Fig. 4
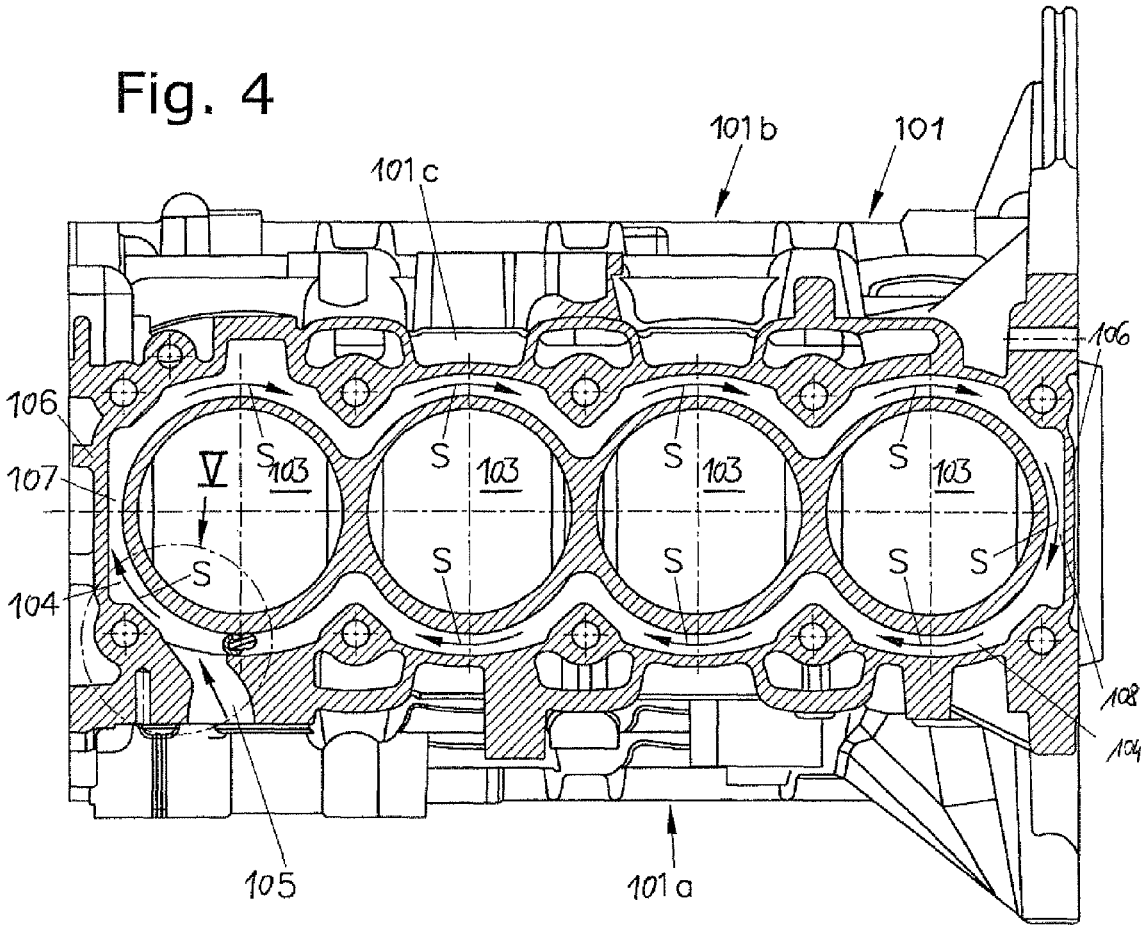
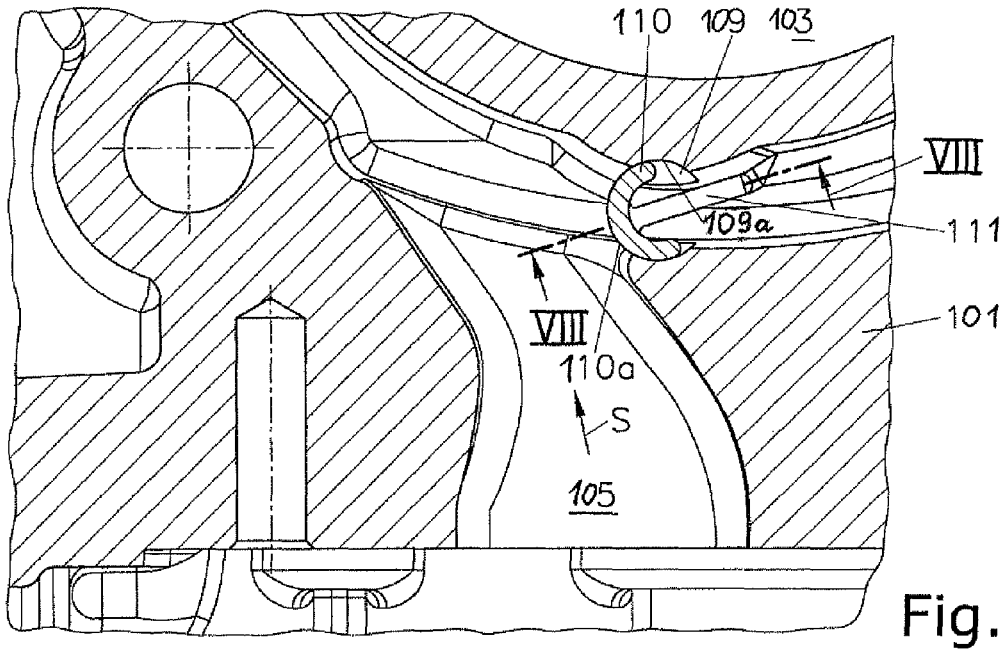
Fig. 5

METHOD FOR MACHINING A CYLINDER HEAD COMPRISING A COOLING JACKET

BACKGROUND OF THE INVENTION

1. Field of the Invention

The invention relates to a method for machining a cylinder head comprising a cooling jacket, with the fire deck of the cylinder head which is in a raw state being machined by material removal in relation to a reference mark of the cylinder head. The invention further relates to a cylinder block for a liquid-cooled internal combustion engine with a cylinder or a group of cylinders which consist of several cylinders Which are cast together, comprising a liquid compartment which encloses the cylinder or group of cylinders and which is enclosed by an outside wall, with gaps being provided between the cylinder or the outer cylinders of the group of cylinders and the outside wall of the cylinder block through which the cooling liquid flows from one side to the other side of the cylinder or the group of cylinders, with at least one plug which reduces the cross section being arranged in at least one gap.

2. The Prior Art

In order to fulfill predefined tolerance requirements for the wall thickness between fire deck and cooling jacket, machining by material removal of the fire deck of a cylinder head is necessary. It is known to use sprue cut-offs in the gas exchange ports in the region of the valve guide cut-offs as reference marks for machining by material removal. This leads to the disadvantage however that relatively large tolerances need to be taken into account for the wall thickness of the fire deck in the region of the valve reinforcing ribs on the exhaust side. In the most extreme of cases, this may lead to insufficient cooling of the valve reinforcing ribs on the exhaust side.

A cylinder block is known from DE 198 40 379 A1 in whose cooling liquid chamber a plug which reduces the flow cross section is arranged in the region of a gap between an outer cylinder and the outside wall of the cylinder block. A defined minimum quantity of cooling fluid is able to pass the plug via cooling-fluid passages.

It is the object of the invention to avoid this disadvantage and to ensure sufficient cooling, especially the valve reinforcing ribs on the exhaust side. It is a further object of the invention to enable a purposeful control of the coolant flow in the cylinder block.

SUMMARY OF THE INVENTION

This is achieved in accordance with the invention in such a way that the position of the cooling jacket is used as a reference mark. It is preferably provided that a defined wall region of the cooling jacket is used as a reference mark.

Very narrow tolerance ranges for the wall thickness of the fire deck in the region of the valve reinforcing ribs can be fulfilled because reference marks of the cooling jacket are used as reference quantities for machining by material removal.

It is especially advantageous in this respect when the wall thickness between a wall region of the cooling jacket and the fire deck is used as a reference mark in the region of least one valve reinforcing rib, especially an exhaust valve reinforcing rib.

A purposeful control of the coolant flow in the cylinder block can be achieved when the plug is arranged in a water transfer port to or from the cylinder head. Retroactive insertion is possible due to the fact that the plug is arranged in a transfer port. The plug preferably has a sickle-shaped cross section, with the plug preferably being pressed against the wall of the transfer port by a positioning bracket which is preferably rigidly connected with the plug. In order to prevent wrong mounting, it is especially advantageous when the transfer port has a substantially oblong cross section, with preferably the plug being insertable in an interlocking fashion and only in a defined position in the transfer port.

It is especially advantageous for the control of the cooling liquid flow when the plug is arranged in the region of a lateral inlet port for the liquid into the liquid chamber, with the convex side of the plug facing the incoming cooling liquid.

The plug can consist of plastic, aluminium, or of steel, e.g. deep-drawing sheet steel. Since 100% sealing by the plug is not required, temperature tensions can be avoided by sufficient play between plug and the cylinder block.

The invention will now be explained in greater detail by reference to the drawings.

BRIEF DESCRITON OF THE DRAWINGS

FIG. 4 shows the cylinder block in a sectional view along line IV-IV in FIG. 8;

FIG. 5 shows the detail V of FIG. 4 of the cylinder block;

DETAILED DESCRIPTION OF THE PREFERRED EMBODIMENTS

Figure 1:
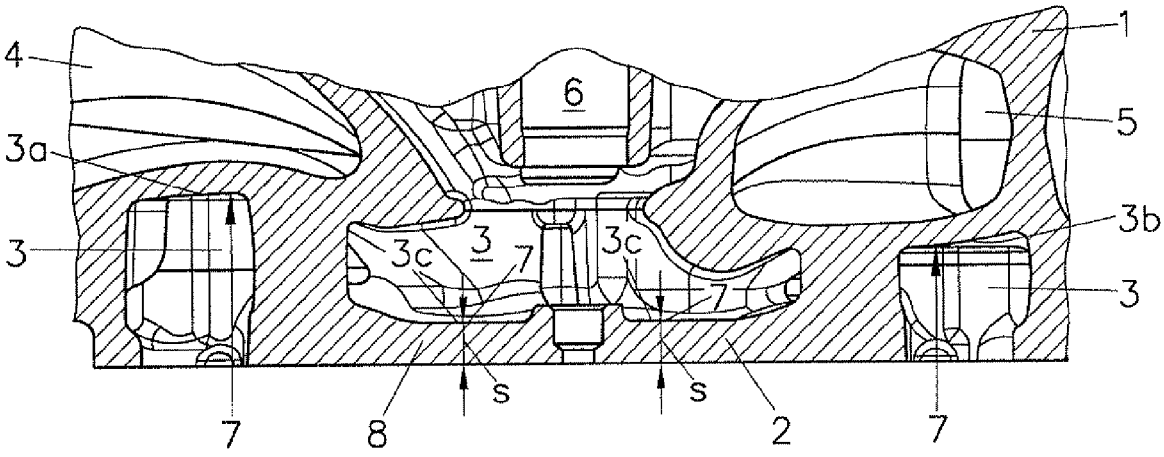
FIG. 1 shows a cylinder head of an internal combustion engine in a cross-sectional view.
Figure 2:
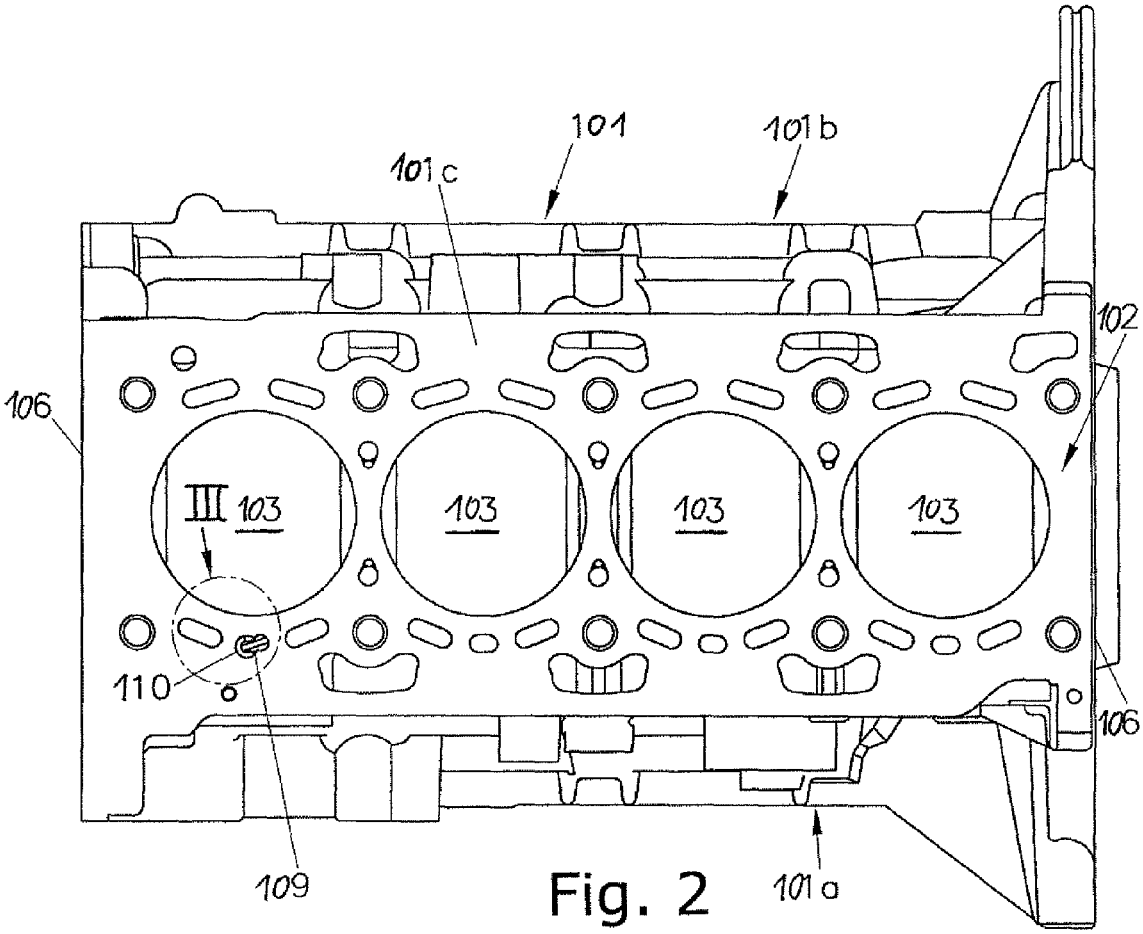
FIG. 2 shows a cylinder block in accordance with the invention in a top view.
Figure 3:
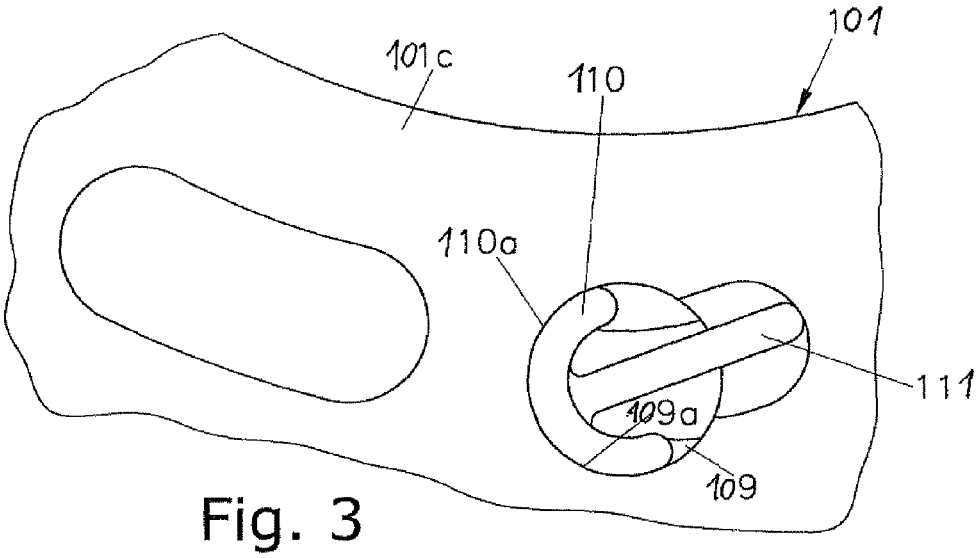
FIG. 3 shows the detail III of FIG. 2 of the cylinder block.
Figure 6:
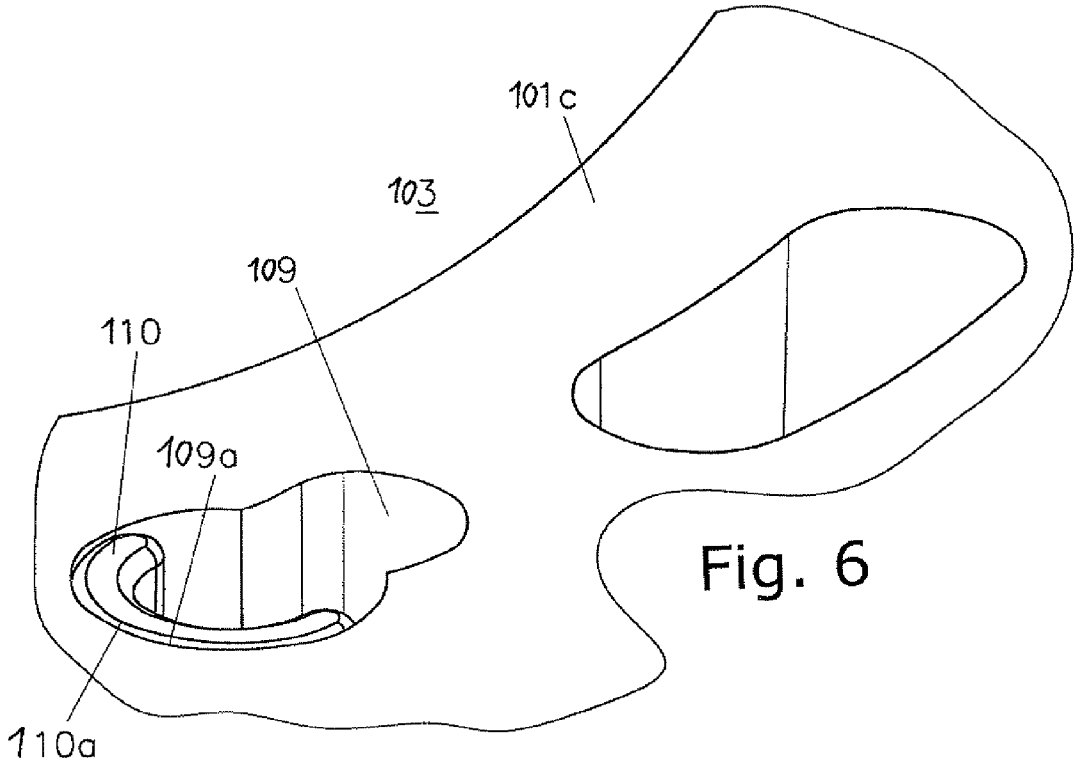
FIG. 6 shows a cylinder-head sealing surface of the cylinder block in a detailed oblique view.
Figure 7:
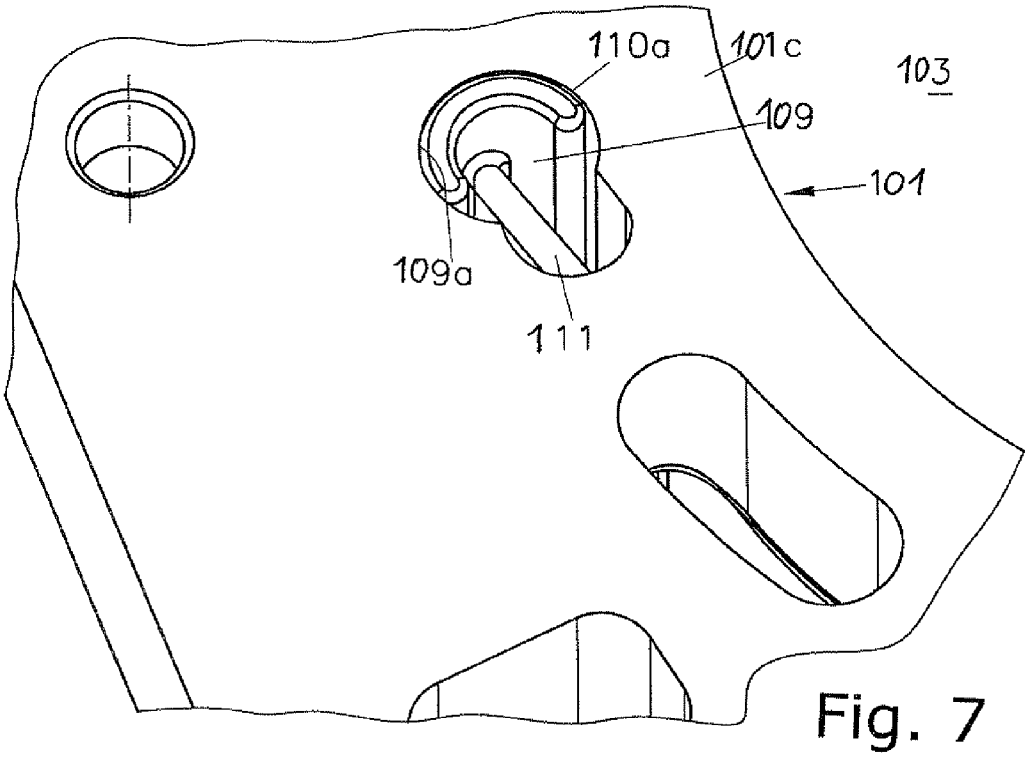
FIG. 7 shows the cylinder-head sealing surface in a further oblique view.

The cylinder head 1 as shown in FIG. 1 comprises a cooling jacket 3 adjacent to the fire deck 2 for receiving cooling liquid and gas exchange ports 4 and 5. Reference numeral 6 indicates the central receiving area for an injection device (not shown in greater detail).

In order to fulfill predefined tolerance requirements for the wall thickness s of fire deck 2, the cast raw cylinder head is subjected to machining by material removal of the fire deck 2, with the machining occurring in relation to a reference mark of cylinder head 1.

According to the present invention, the cooling jacket 3 or a defined wall region 3*a*, 3*b*, 3*c* or the wall thickness s of the fire deck 2 in the region of at least one valve reinforcing rib 8 itself, e.g., an exhaust valve reinforcing rib, is used as a reference mark 7. The wall thickness s can be determined and monitored with a known destruction-free measuring method, e.g., an ultrasonic or X-ray method. This allows fulfilling much narrower tolerance requirements than before and ensuring sufficient cooling and strength of the cylinder head 1.

A cylinder block 101 comprises a group 102 of several cylinders 103 which are arranged in series (FIGS. 2 to FIG. 9). Cylinders 103 are enclosed by cooling liquid in a liquid compartment 104, with the cooling liquid flowing into the liquid compartment 104 via a lateral inlet 105. Reference numeral 101*c* designates the cylinder head sealing surface of the cylinder block 101. Gaps 107, 108 are formed between the outer cylinders 103 and the outside wall 106 of the cylinder block 101 through which the cooling liquid can flow from one side 101*a* of the cylinder block 101 to the other side 101*b*. Between the individual cylinders 103, no flow connection is provided in the embodiment between the sides 101*a*, 101*b* of the liquid compartment 104. A plug 110 of a substantially sickle-shaped cross section is arranged directly in the region of the inlet 105 in a transfer port 109 between the cylinder block 101 and the cylinder head (not shown in greater detail). The transfer duct 109 has a substantially pear-shaped cross section. In order to ensure the positioning of the plug 110 in the transfer duct 109 which is positionally correct, the plug 110 comprises positioning brackets 111 which press the plug 110 with its convex outside 110*a* against the concave wall 109*a* of the transfer duct 109. The convex outside 110*a* of plug 110 faces the cooling liquid flowing in via the inlet port 105. The plug 110 can be inserted in an interlocking fashion and correctly positioned into the transfer port 109 as a result of the precisely defined cross sections of plug 110, so that wrong installation can be excluded.

The cooling fluid flows through the inlet port 105 according to the arrows S into the liquid compartment 104 and reaches through gap 107 to the other side 101*b* of cylinder block 101, with the cooling liquid being guided by the plug 110 in the direction of gap 107. Thereupon liquid flows around the cylinders 103 at one side 101*b* in the longitudinal direction of the cylinder block 101.

The cooling liquid finally reaches the side 101*a* of the cylinder block 101 via gap 108 and flows around the cylinder 103 in the longitudinal direction in the direction towards the transfer port 109. The cooling liquid is now guided through the transfer port 109 in the direction of the cylinder head by the plug 110.

Figure 8:
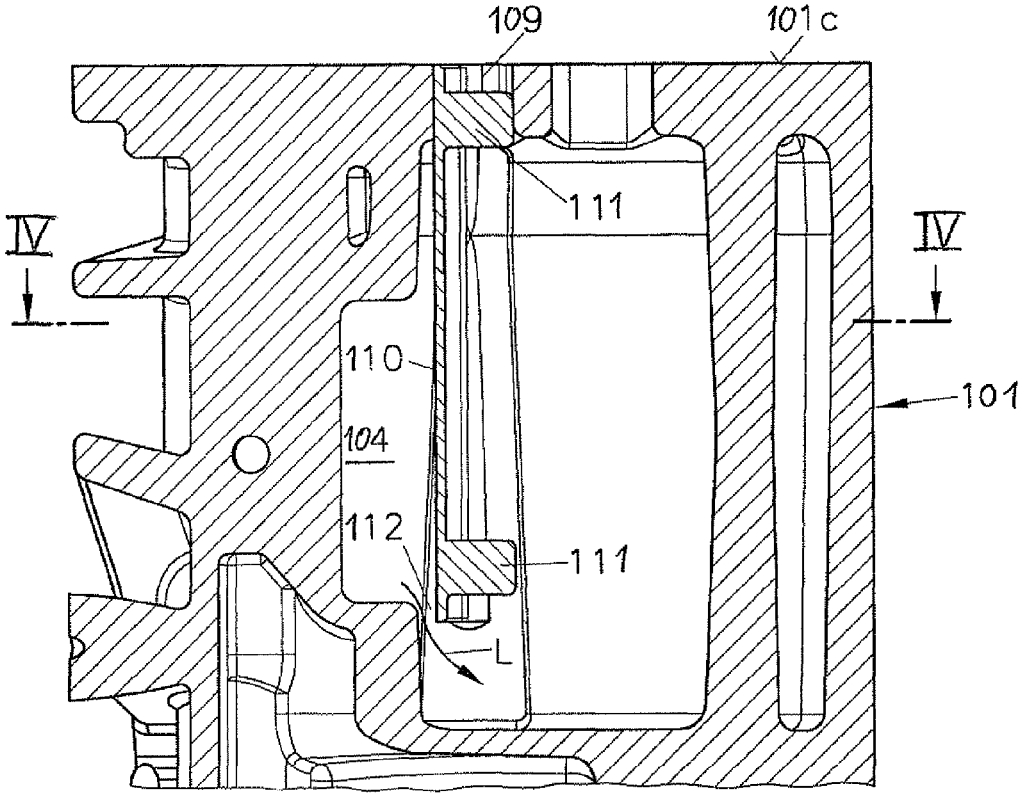
FIG. 8 shows a cylinder block in accordance with the invention in a longitudinal view along line VIII-VIII in FIG. 5.
Figure 9:
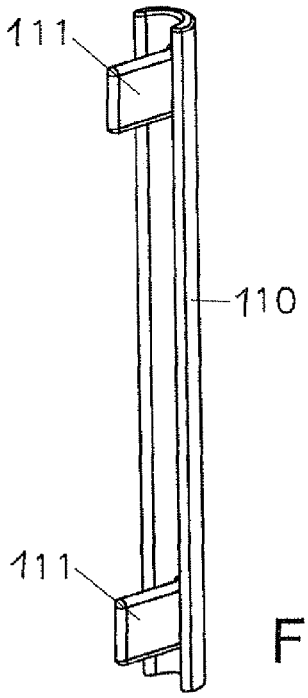
FIG. 9 shows a plug in an oblique view.

As is shown in FIG. 8, a total sealing of the liquid compartment 104 by the plug 110 is neither provided nor desired, so that a short-circuit flow L of small quantities of liquid is possible via defined leakages 112.

The plug 110 itself can consist of plastic or aluminium. A defined play to the cylinder block 101 should be provided especially in the case of arrangements with aluminium in order to avoid temperature tensions.

The invention claimed is:

1. A cylinder block for a liquid-cooled internal combustion engine, comprising:

a cylinder or a cylinder group consisting of several cylinders which are cast together, a liquid compartment which encloses the cylinder or the cylinder group and which is enclosed by an outside wall, with gaps being provided between the cylinder or outer cylinders of the cylinder group and an outside wall of the cylinder block through which a cooling liquid flows from one side to another side of the cylinder or cylinder group, and a plug which reduces a cross section being arranged in at least one gap, wherein the plug is arranged in a water transfer port to or from a cylinder head, wherein the plug can be inserted into the transfer port in an interlocking fashion and only in one defined position, and wherein the plug includes at least one positioning bracket rigidly connected thereto for pressing the plug against a wall of the transfer port, wherein the plug is arranged in a region of a lateral inlet port for the liquid into the liquid compartment, with a convex side of the plug facing incoming cooling liquid.

2. The cylinder block according to claim 1, wherein the plug has a substantially sickle-shaped cross section.

3. The cylinder block according to claim 1, wherein the plug consists of plastic.

4. The cylinder block according to claim 1, wherein the plug consists of aluminum.

5. The cylinder block according to claim 1, wherein the plug consists of steel.

6. The cylinder block according to claim 1, wherein the transfer port has a substantially oblong cross section.

* * * * *

UNITED STATES PATENT AND TRADEMARK OFFICE

CERTIFICATE OF CORRECTION

PATENT NO. : 8,662,027 B2
APPLICATION NO. : 12/452376
DATED : March 4, 2014
INVENTOR(S) : Knollmayr et al.

It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 470 days.

Signed and Sealed this
Twenty-ninth Day of September, 2015

Michelle K. Lee

Michelle K. Lee
*Director of the United States Patent and Trademark Office*